US006515578B1

(12) United States Patent
Kajimura

(10) Patent No.: US 6,515,578 B1
(45) Date of Patent: Feb. 4, 2003

(54) RADIO PAGING RECEIVER WITH MESSAGE DISPLAY FUNCTION

(75) Inventor: Hideki Kajimura, Shizuoka (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/085,958

(22) Filed: May 27, 1998

(30) Foreign Application Priority Data

May 27, 1997 (JP) ..... 9-136821

(51) Int. Cl.[7] ..... G08B 5/22
(52) U.S. Cl. ..... 340/7.56; 340/7.52
(58) Field of Search ..... 340/825.81, 825.44, 340/825.27, 5.1, 2, 825.47, 825.37, 825.48, 7.47, 7.52, 7.55, 7.56, 7.51; 455/31.1, 38.4, 31.3; 345/471; 707/534, 535

(56) References Cited

U.S. PATENT DOCUMENTS 5,107,259 A * 4/1992 Weitsen et al. ..... 340/825.44
5,212,477 A * 5/1993 Indekeu et al. ..... 340/825.44
5,629,688 A * 5/1997 Muramatsu et al. ..... 340/7.47
5,825,353 A * 10/1998 Will ..... 345/184
5,835,084 A * 11/1998 Bailey et al. ..... 345/326
5,936,548 A * 8/1999 Takatsuka ..... 340/825.44

FOREIGN PATENT DOCUMENTS

KR 96-6422 2/1996

* cited by examiner

*Primary Examiner*—Michael Horabik
*Assistant Examiner*—William Bangachon
(74) *Attorney, Agent, or Firm*—Scully, Scott, Murphy & Presser

(57) ABSTRACT

A radio paging receiver with a message display function according to the present invention can display and memorize two or more messages. The radio paging receiver with a message display function comprises a message control unit. The message control unit includes first and second character tables and a message memory. The first and second character tables are for displaying the messages with first and second character types, respectively. The messages stored in the message memory are displayed on the display window in either one of a multiple message display mode or a single message display mode. The message control unit displays the reception messages with the characters of either the first or second character type when the multiple message display mode is selected. When the single message display mode is selected, then only one of the messages is displayed on the window with the characters of the other of the first or second character type.

18 Claims, 9 Drawing Sheets

RADIO PAGING RECEIVER WITH MESSAGE DISPLAY FUNCTION

BACKGROUND OF THE INVENTION

The present invention relates to a radio paging receiver with a message display function. More particularly, the present invention relates to a radio paging receiver with a message display function that allows a user to choose any one of a plurality of messages with one or more characters of a predetermined language or languages including, for example, kanji, katakana, hiragana, and alphanumeric letters of the same or different sizes.

An example of a conventional radio paging receiver with a message display function is disclosed in Japanese Patent Laid-Open No. 8-19022. One feature of the radio paging receiver lies in easy-to-read displaying of a reception message on a smaller display panel. When the characters are too small for a user to read, the radio paging receiver magnifies each character of the reception message in response to simultaneous depression of a light switch and a scroll switch. The user may just depress the switches when he or she wants to magnify the difficult-to-read characters. However, only some of the first characters are displayed on due to the dimensional limitation of the display panel. The remaining portion of the reception message may be displayed on when the user depresses the scroll switch. The scroll switch should be depressed continuously until the end of the reception message appears to display the entire message. The magnified characters are returned to their original size in response to the re-depression of the light switch and the scroll switch at the same time. In the above-mentioned radio paging receiver with the message display function, the characters of the only one reception message at a time can be magnified for the clear appearance.

Typical radio paging receivers with a message display function of this type can display a reception message with a combination of kanji, katakana, hiragana, alphanumeric letters or those of other languages of different sizes.

The radio paging receiver may comprise a memory unit for storing two or more reception message. However, the small dimension of the display panel is a limitation to a display capacity, i.e., the number of messages that can be displayed on the panel at the same time. To display more messages than the capacity, the reception messages to be displayed should be selected and retrieved from the memory unit one by one, which is relatively bothersome or troublesome.

SUMMARY OF THE INVENTION

Therefore, an object of the present invention is to provide a radio paging receiver with a message display function that allows simultaneous displaying of two or more reception messages, a desired one of which can be selected and magnified with a simple operation.

It is another object of the present invention to provide a radio paging receiver with a message display function that provides rapid selection of a reception message with a combination of, for example, kanji, katakana, hiragana, alphanumeric letters or those of other languages of the different sizes, or with a combination of characters of one language, and provides displaying of the characters of the selected reception message in a different font from the remaining set of the reception messages.

A radio paging receiver with a message display function according to the present invention can display and memorize two or more reception messages. The radio paging receiver with a message display function comprises a message control unit. The message control unit includes first and second character tables and a message memory for memorizing messages. The first and second character tables are for displaying the messages with first and second character types, respectively. The messages stored in the message memory are displayed on the display window in either one of a multiple message display mode or a single message display mode. The message control unit displays the messages with the characters of either the first or second character type when the multiple message display mode is selected. When the single message display mode is selected, then only one of the messages is displayed on the display window with the characters of the other of the first or second character type.

DESCRIPTION OF THE PREFERRED EMBODIMENTS

Figure 1:
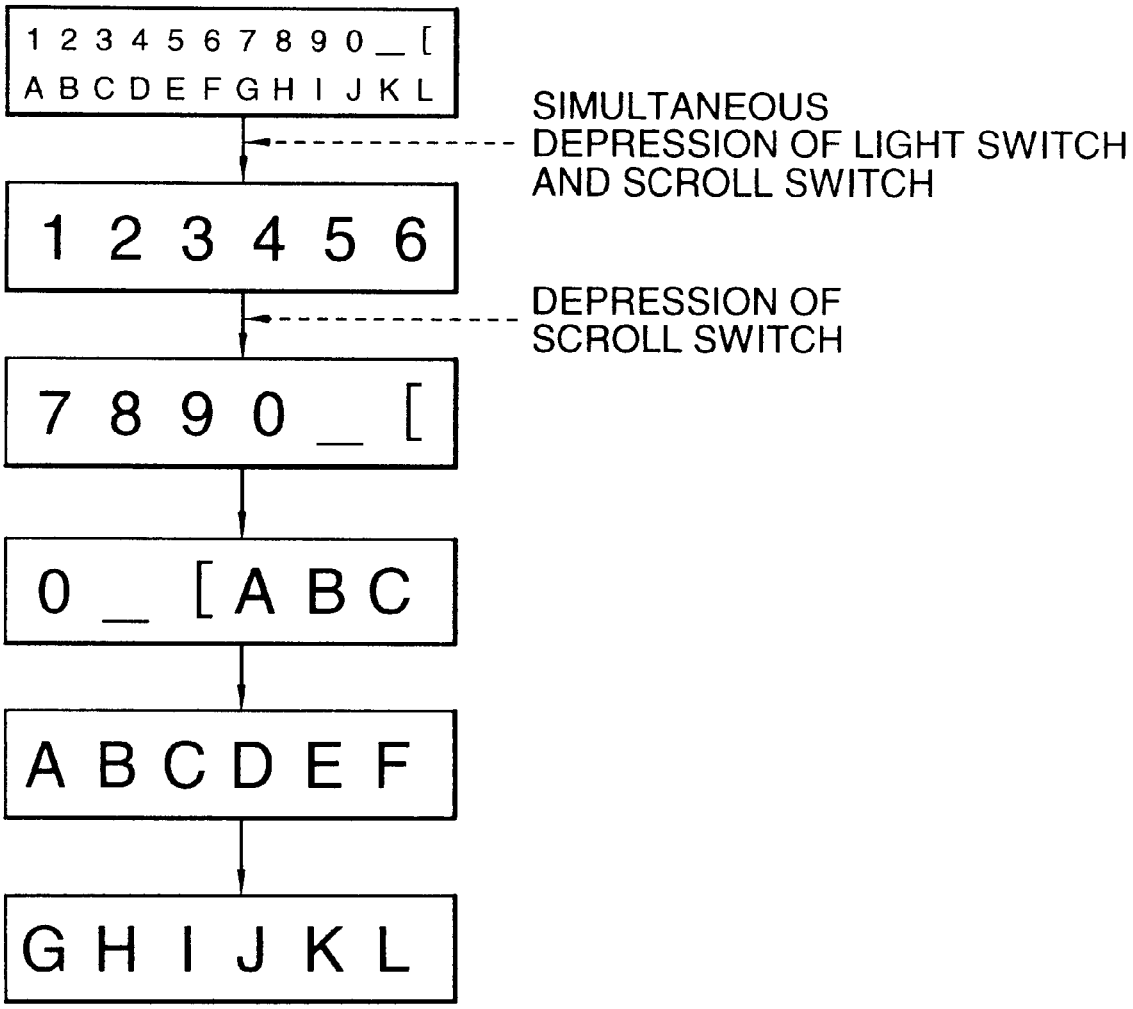
FIG. 1 PRIOR ART
FIG. 1 is a view showing examples of reception messages on a conventional radio paging receiver with a message display function.

Referring to FIG. 1, a conventional radio paging receiver with a message display function is described in conjunction with how to display a reception message thereon. The radio paging receiver in question is disclosed in the above-mentioned Japanese Patent Laid-open No. 8-19022. One feature of the radio paging receiver lies in easy-to-read displaying of a reception message, though on a smaller display panel. When the characters are too small for a user to read (status S1), the radio paging receiver magnifies each character of the reception message (status S2) in response to simultaneous depression of a light switch and a scroll switch. The user may just depress the switches when he or she wants to magnify the difficult-to-read characters. However, only the some first characters are displayed on due to the dimensional limitation of the display panel. The remaining portion of the reception message may be displayed on when the user depresses the scroll switch (status S3). The scroll switch should be depressed continuously until the end of the reception message appears to display the entire message (status S4–S6). The magnified characters are turned to their original size in response to the re-depression of the light switch and the scroll switch at the same time. In the above-mentioned radio paging receiver with the message display function, the characters of the only one reception message at a time can be magnified for the clear appearance.

Typical radio paging receivers with a message display function of this type can display a reception message with a combination of kanji, katakana, hiragana, alphanumeric letters or those of other languages of different sizes. The radio paging receiver may comprise a memory unit for storing two or more reception message. However, the small dimension of the display panel is a limitation to a display capacity, i.e., the number of messages that can be displayed on the panel at the same time. To display more messages than the capacity, the reception messages to be displayed should be selected and retrieved from the memory unit one by one, which is relatively bothersome or troublesome.

Figure 2:
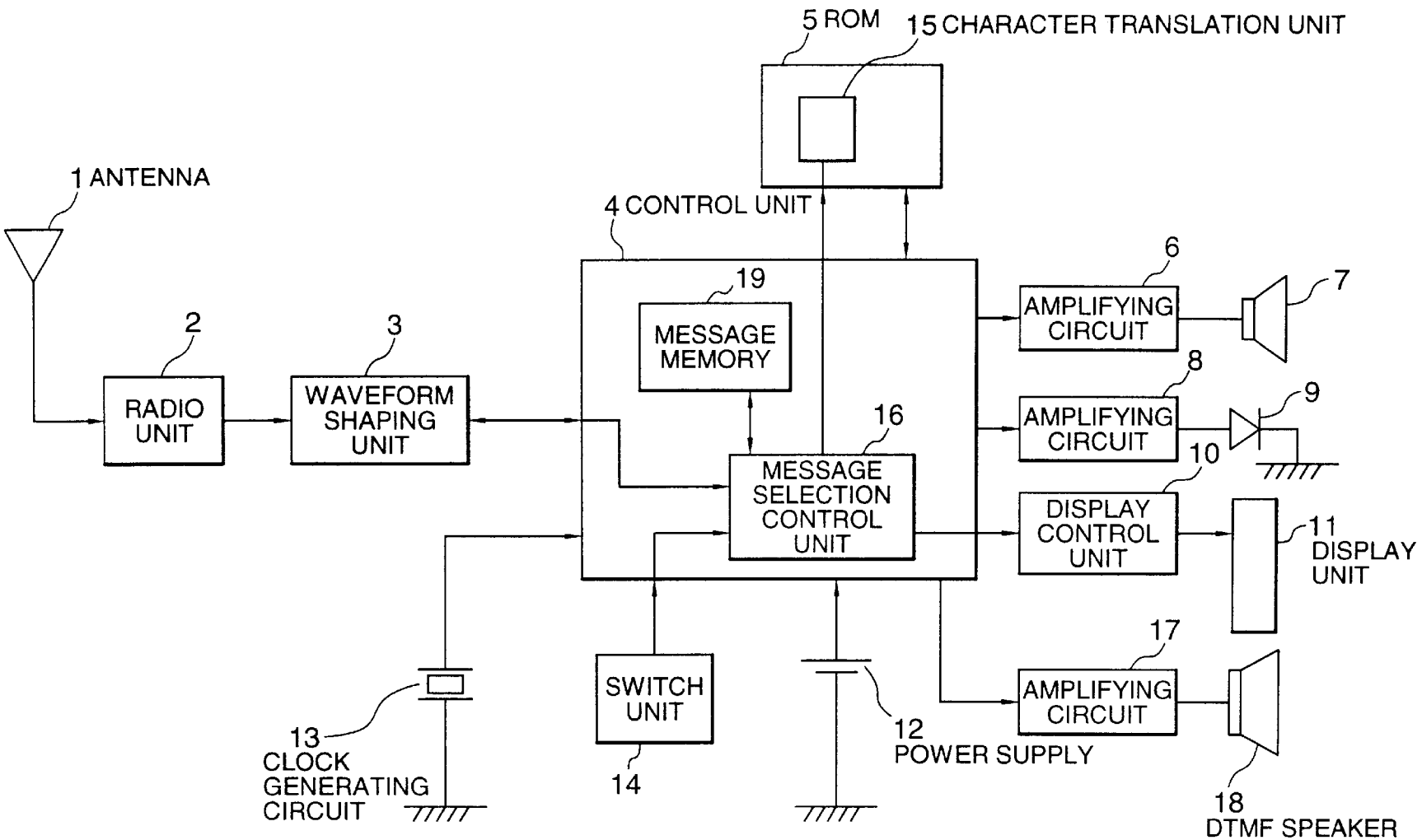
FIG. 2 is a block diagram showing a configuration of a radio paging receiver with a message display function according to an embodiment of the present invention.
Figure 3:
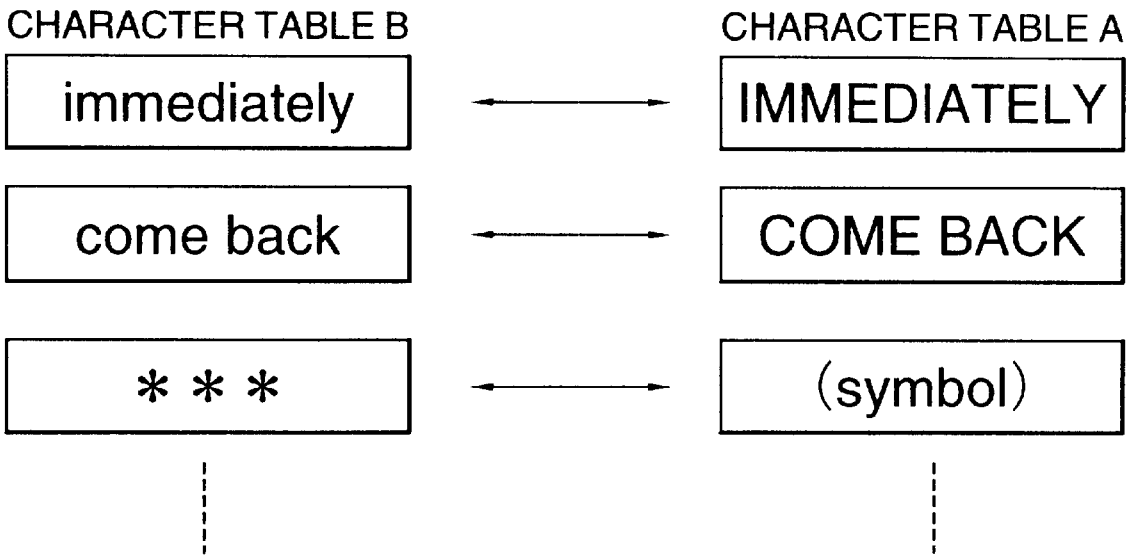
FIG. 3 is a view showing comparison of two character tables used in the radio paging receiver with a message display function of the present invention.
Figure 4:
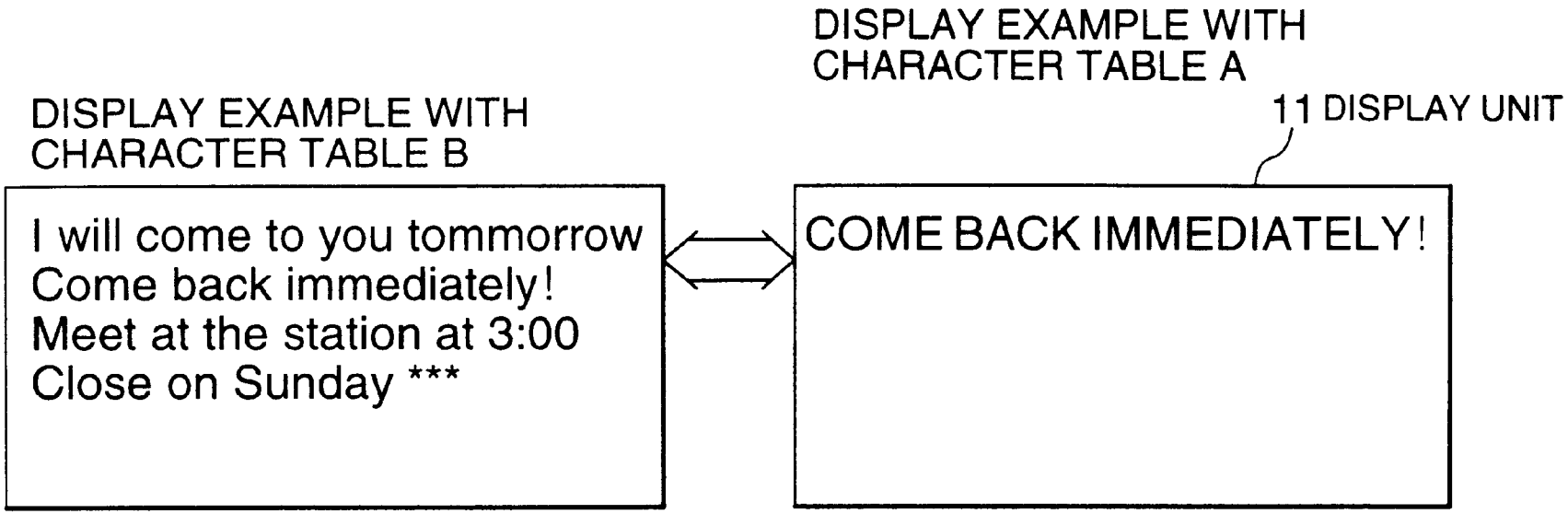
FIG. 4 is a view showing examples of reception messages on the radio paging receiver with a message display function of the present invention.

A radio paging receiver with a message display function (hereinafter, referred to as a radio paging receiver) of the present invention is described. FIG. 2 is a block diagram showing a configuration of the radio paging receiver according to a first embodiment of the present invention. FIG. 3 is a view providing comparison between characters of a character set CA in a character table A and those of a character set CB in a character table B. FIG. 4 is a view showing examples of reception messages on the radio paging receiver according to the present invention. Now, a configuration and operation of the radio paging receiver according to a first embodiment of the present invention is described with reference to FIGS. 2 through 4.

In FIG. 2. an antenna 1 receives a radio signal from a base station for a paging system. The radio signal includes a call number for use in designating a particular radio paging receiver. The call number is hereinafter referred to a designated call number. A radio unit 2 amplifies the radio signal received at the antenna 1. The radio unit 2 then demodulates the amplified radio signal into a baseband signal. The demodulated baseband signal is supplied to a waveform shaping circuit 3 where the waveform thereof is shaped into a format acceptable and readable by a control unit 4. The control unit 4 compares a local call number previously stored in a programmable read-only memory (PROM) 5 with the designated call number contained in the signal from the waveform shaping circuit 3. The control unit 4 activates amplifying circuits 6 and 8 when the local call number coincides with the designated call number. In response to this, the radio paging receiver beeps a speaker 7 and illuminate a light-emitting diode (LED) 9 to inform a user of the reception of a call. The control unit 4 activates a display control unit (LCD driver) 10 when the signal from the waveform shaping circuit 3 contains a message. The message is then displayed on a window of a display unit 11 as a reception message. The display unit 11 is achieved by a known LCD or the like.

The control unit 4 is a microprocessor (CPU)-based unit. The control unit 4 controls operations of the radio paging receiver according to a program stored in the PROM 5. The control unit 4 comprises a message memory 19 in which the reception message is stored in a form of the character table A or the character table B. The PROM 5 has a character translation unit 15 for translating the characters, forming the message, of a type CA in the character table A into the characters of a type CB in the character table B, or vise versa. The translation is carried out by a message selection control unit 16 in the control unit 4. The reception message is displayed on the window of the display unit 11 by the display control unit 10 with the character type obtained upon translation performed in response to a control command from the message selection control unit 16. The character type is defined by a size and a face of each character. The size means a dimension of each character. The face may be, for example, kanji, katakana, hiragana, or alphabet.

The radio paging receiver further comprises a power supply 12, a clock generating circuit 13, and a switch unit 4. The power supply 12 is for supplying power to the components of the receiver, which is a battery to be used as a primary power source. The clock generating circuit 13 is for generating clock signals for operation of circuits. The switch unit 14 contains a set of switches and a push switch. Each switch of the set is slidable upward and downward. The switch unit 14 plays an important role in selecting and determining the message display as described below.

The control unit 4 generates a Dual-Tone Multi-Frequency (DTMF) signal. The DTMF signal from the control unit 4 is amplified by an amplifying circuit 17. A DTMF speaker 19 visualizes a received or a created DTMF message.

As apparent from FIGS. 3 and 4, the each character of the type CA is a double size of a two-byte code character.

The character of the type CB is a one-byte code character or an ASCII code character. The message selection control unit 16 can translate a portion of the reception message, •¯shikyuu¯ in kanji (IMMEDIATELY)¯ and •¯modore¯ in kanji (COME BACK)¯ of the type CA into •¯shikyuu¯ in katakana (immediately)¯ and •¯modore¯ in katakana (come back)¯ of the type CB.

The character table B may not have a suitable correspondence to an abstract image of, for example, the sun, a symbol, or an original code created by a user. When the reception message contains such a character in the table A, then the message selection control unit 16 provides an alternating character such as an aster. As a result, a symbol of the sun may be represented as •¯.

In FIG. 4, the view on the left side shows an example of four reception messages on the display window in which each character is a type (one-byte code) in the character table B. The receiver is in a multiple message display mode. The multiple message display mode provides the reception messages with the small characters (one-byte code characters) . This allows simultaneous display of two or more messages on a single window. Thus, it is easier to choose a desired one of the reception messages. It is noted that only the first some characters of each message are appeared on the window. The view on the right side shows an example where one of the four reception messages (the second one in this case) is selected and displayed on the window. The receiver is in a single message display mode. The selected reception message appears with the larger characters (double two-byte code characters) than that (with one-byte code characters) in the multiple message display mode. The message is easier-to-read because only one is displayed on the window.

Figure 5:
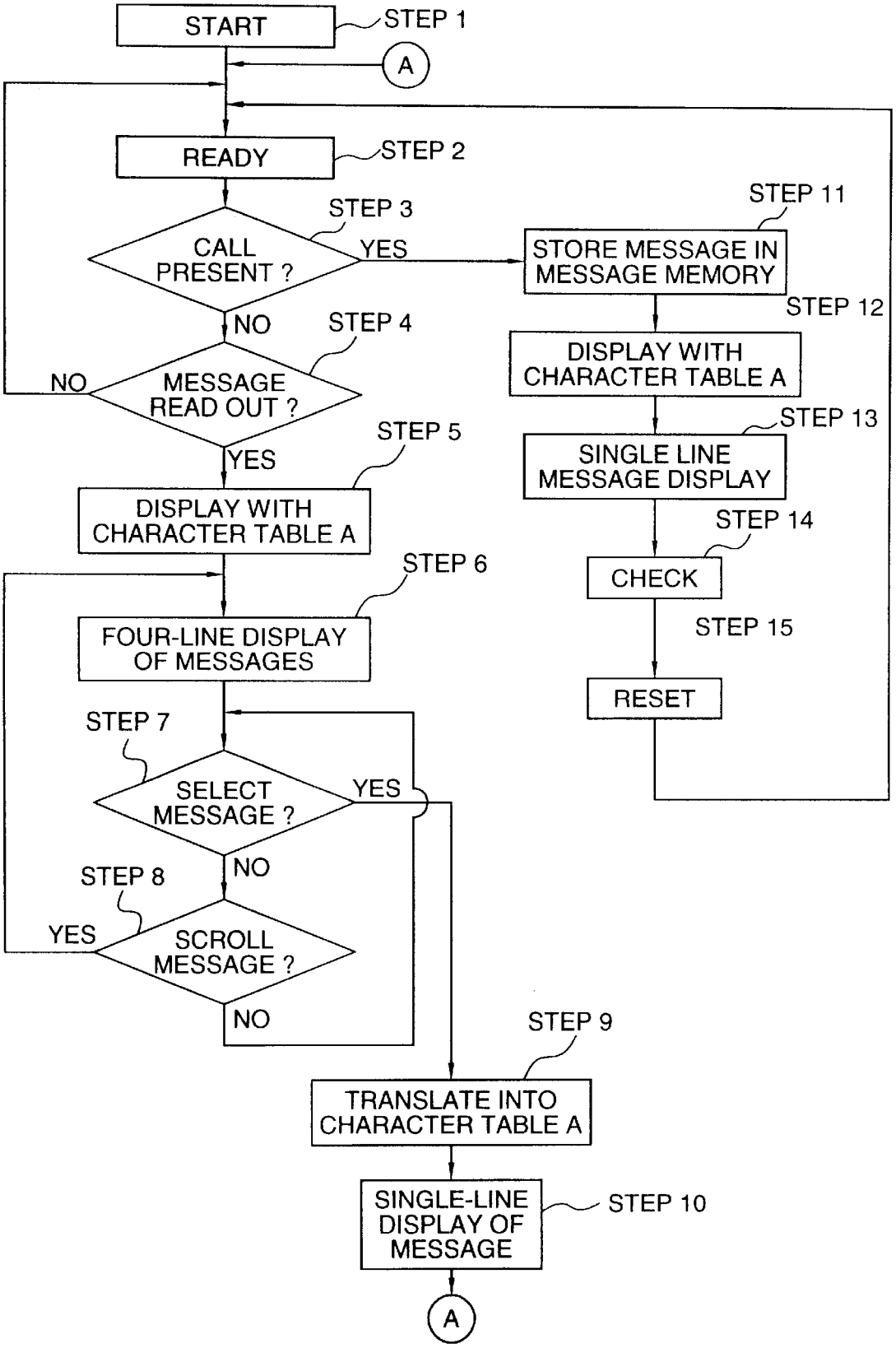
FIG. 5 is a flow chart for use in describing operation of the radio paging receiver with a message display function of the present invention.

Operation of the radio paging receiver according to the first embodiment is described with reference to a flow chart in FIG. 5. Referring to FIGS. 2 and 5, the radio paging receiver is operated (Step 1) in response to turning on of a switch for the power supply 12. The radio paging receiver is in a ready state (Step 2). In response to a call from a paging system (YES at Step 3), the control unit 4 stores the received message into the message memory 19 as a reception message (Step 11). Upon this calling, the control unit 4 commands the message selection control unit 16 to display only the reception message on the window with the character type CA in the character table A (Step 12). The message selection control unit 16 displays one reception message in each line on the window of the display unit 11 with double-sized ASCII code characters (Step 13). Upon checking the reception message (Step 14), then he or she resets the display (Step 15).

Then, the radio paging receiver is again in the ready state (Step 2).

If no call is made in Step 3 (NO at Step 3). then the radio paging receiver returns to the ready state (from NO at Step 4 to Step 2). The user may read out a previously received message (YES at Step 4). When the user reads out the previously received message (YES at Step 4), then the control unit 4 reads the four reception messages out of the message memory 19 and commands the message selection control unit 16 to display the reception messages with the character type CB (Step 5). The message selection control unit 16 successively changes the size of the four reception messages into the one-byte code size by means of the character translation unit 15. The translated four reception messages are then successively displayed on the window of the display unit 11. The display control unit 10 allocates a space for only a single line per message, of the display window and the first some characters of the reception message are displayed on the window. In the similar manner, the four reception messages are displayed on respective lines (Step 6).

Next, the user chooses a reception message that he or she wants to expand to (Step 7). For choosing the message (NO at Step 7), the window with the reception messages is scrolled up or down (Step 8). In response to the selection of one message (YES at Step 7), then the message selection control unit 16 translates the selected reception message. More specifically, the message with the characters of the type B is changed into the one with the double-sized two-byte code characters of the type A by means of the character translation unit 15 (Step 9). The message selection control unit 16 drives the display control unit 10 to display the selected one message with the double-sized two-byte code characters in a single line on the window (Step 10). The control then returns to the Step 2.

Figure 6:
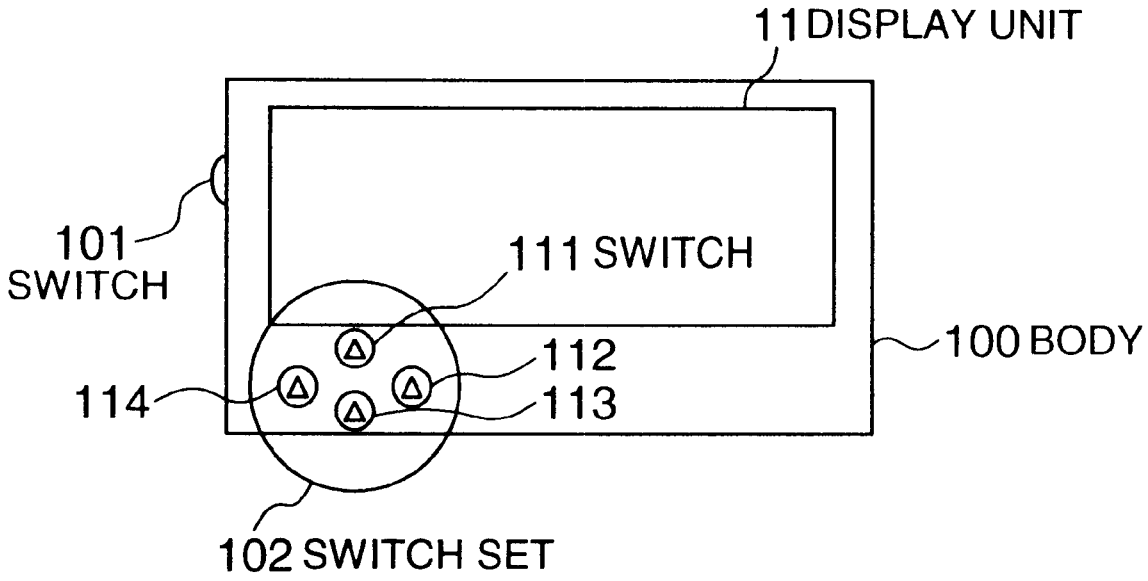
FIG. 6 is a front view of the radio paging receiver with a message display function of the present invention.

FIG. 6 is a front view of the radio paging receiver shown in FIG. 2. FIGS. 7A through 7D illustrate a process for choosing one reception message to be magnified.

As shown in FIG. 6, the display unit 11 is arranged on the front surface of a body 100 of the radio paging receiver. A significant portion of the display unit 11 is the display window. A switch 101 is provided on the side of the body 100. The switch 101 is a push switch. A set of switches 102 is provided on the body away from the display unit 11. The set of switches 102 comprises four switches 111, 112, 113, and 114 that are slidable upward and downward. A triangle projection is attached to each surface of the switches 111 through 114. The triangle projections indicate movable directions of the scrolling. For example, the switch 111 may be for •upward scrolling¯, the switch 112 for •rightward scrolling¯, the switch 113 for •downward scrolling¯, and the switch 114 for •leftward scrolling¯. The switch 101 and the switch set 102 are in the switch unit 14 in FIG. 2.

Referring to FIG. 7, usage of the switch 101 and the switch set 102 in FIG. 6 is described. The display window has a five-line capacity. The first line is allocated for management of the radio paging receiver and contains, for example, icon symbols. The second through fifth lines are for reception messages.

In FIGS. 7A through 7D, all the four lines have the reception messages with the characters of the type CB according to the instruction from the message selection control unit 16. A reception message 115 in the second line provides •29: call me. Michael. A reception message 116 in the third line provides •[30]: back to office immediately!¯ A reception message 117 in the fourth line provides •[01]: call at 0537-22-8237¯. A reception message 118 in the fifth line Provides •02: meet at 06 •Karaoke¯ at station¯. Moving a cursor results in high-lightened appearance of the characters of the message selected. For example, the selected reception message 116 is high-lightened in FIG. 7A. This high-light marking is used like a line high-light on a computer display.

Figure 7A:
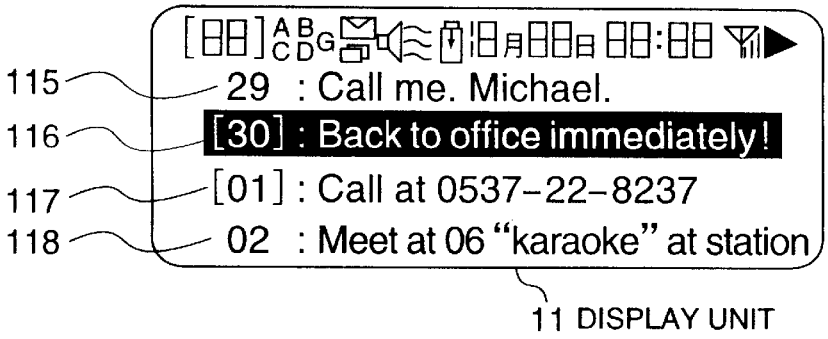
FIGS. 7A through 7D illustrate a process for choosing one reception message to be magnified.
Figure 7B:
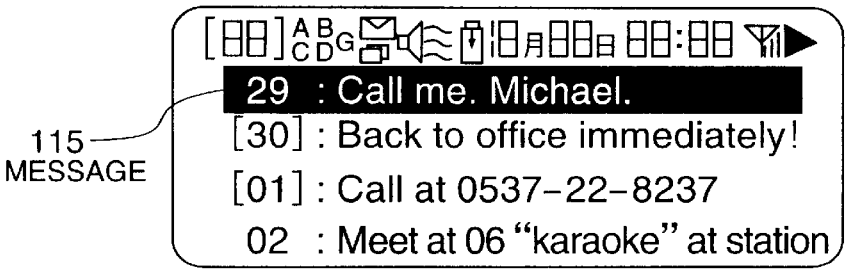
Figure 7C:
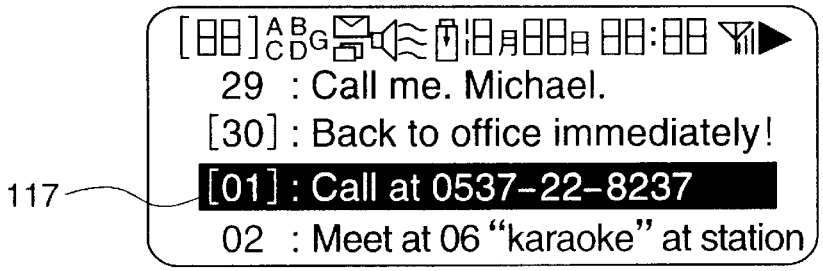
Figure 7D:
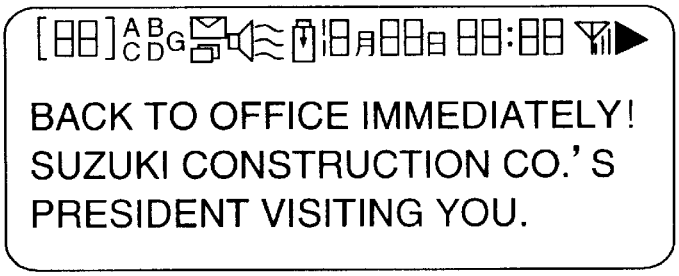

When the switch 101 is depressed with the reception message 116 high-lightened, the reception message 116 is determined as the one to be displayed with the characters of the type CA. The message selection control unit 16 then translates the reception message 116 into the one with the characters of the type CA by means of the character translation unit 15. As shown in FIG. 7D, the message selection control unit 16 displays the reception message 116 with the double-sized two-byte code characters, as •SUZUKI CONSTRUCTION CO.•S CEO VISITING YOU, on the display window of the display unit 11 in two lines. The space required to display each character is four times as large, so that the reception message is displayed in two lines. The reception messages 115, 117, and 118 which are not selected are not displayed on the window.

Next, description is made in conjunction with the case where the reception message other than the reception message 116 is displayed with the characters of the type CA. To select the reception message 115 in the second line in FIG. 7A, it is high-lightened first. Depression of the switch 111 moves the high-light to the upper line. When the reception message is high-lightened, the reception message 115 is selected for being displayed with the characters of the type CA (see FIG. 7B). Depression of the switch 101 decides to display the reception message 115 with the characters in the table A. Likewise, depression of the switch 113 high-lights the reception message 117 and subsequent depression of the switch 101 selects and determines the reception message 117 to be displayed with the characters CA (see FIG. 7C).

Figure 8:
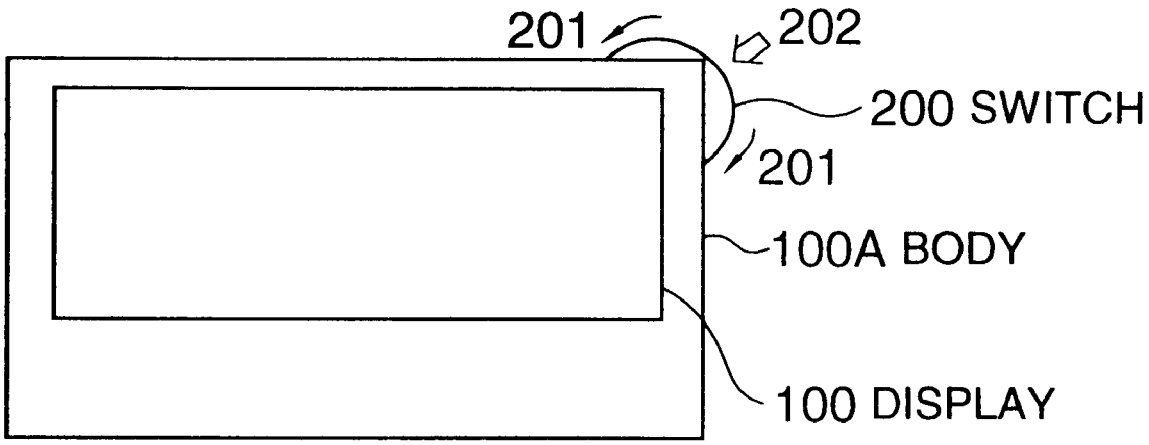
FIG. 8 is a front view of a radio paging receiver with a message display function according to another embodiment of the present invention.

A radio paging receiver according to a second embodiment of the present invention is described. FIG. 8 is a front view of a radio paging receiver with a message display function according to another embodiment of the present invention. The radio paging receiver is similar to the one described in conjunction with the first embodiment except for the switches. Description of such similar components will be omitted.

As shown in FIG. 8, a rotary switch (jog switch) 200 is provided at a corner on the side of a body 110A of the radio paging receiver for use in selecting and determining one of the reception messages (with the enlarged display of the characters CA). The rotary switch 200 is similar in function to the switch set 102 (FIG. 6) and moves the high-lightened box for the message up and down to select the message. The rotary switch 200 comprises a push switch 202. Depression of the push switch 202 indicates that the reception message selected at that time is to be enlarged for display. Such a rotary switch improves switching operativity.

Figure 9A:
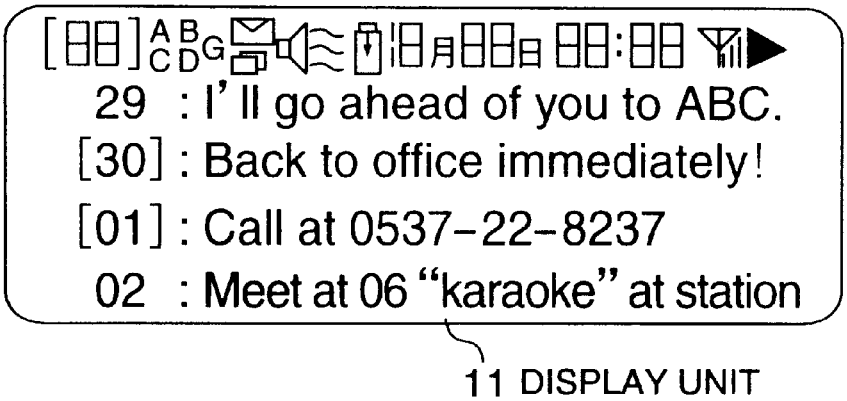
FIGS. 9A through 9C illustrate a reception message displayed in different modes on the radio paging receiver with a message display function of the present invention.
Figure 9B:
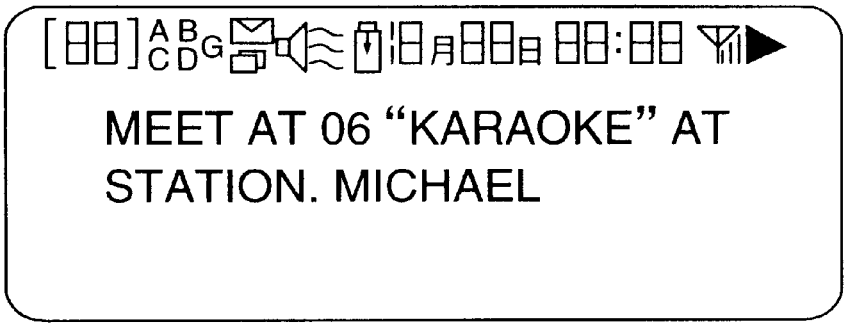
Figure 9C:
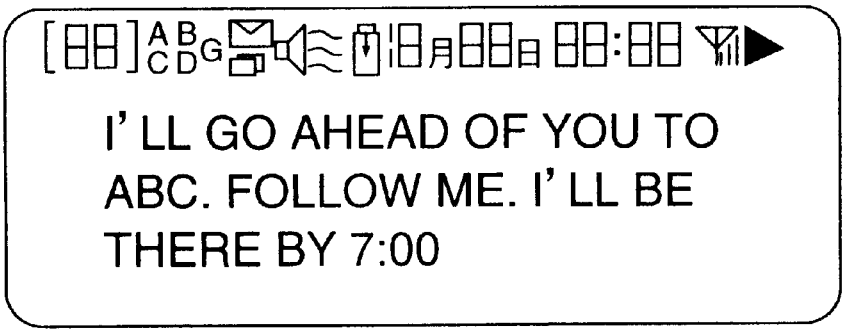

FIGS. 9A through 9C a reception message displayed in different modes on the radio paging receiver with a message display function of the present invention. FIGS. 9A through 9C illustrate different examples of the message display.

In the above-mentioned first embodiment, the messages consist of alphanumeric characters. However, the message may be a combination with other characters or symbols. Of course, the reception message may consist of characters for other language or languages. In such a case, the characters should be determined with two sizes, a larger size for a single-line display and a smaller size for a multiple-line display. The message may consist of different type characters of different languages.

FIGS. 9A through 9C illustrate messages formed of a combination of alphanumeric characters and Japanese characters. FIG. 9A is in a multiple message display mode. FIGS. 9B and 9C are in a single message display mode for the reception messages 02 and 29, respectively, in FIG. 9A. It is noted that the number of the tables should be increased that are to be translated by the character translation unit 15 when the present invention is applied to a reception message with the mixed types of characters.

As described above, according to the present invention, the reception messages are displayed on the window simultaneously. This allows quick selection of one of the messages from the two or more messages.

In addition, according to the present invention, the character type is changed for the selected display of one of the messages. This provides easier-to-read appearance of the message.

Furthermore, the present invention provides easy and simple operation for the selection and determination of the message. Selection of the message to be magnified can be made only by means of high-lightening that message.

What is claimed is:

1. A radio paging receiver with a message display function to display and memorize two or more reception messages, comprising:

message control means including first and second character tables and a message memory for memorizing the messages, the first and second character tables being for displaying the messages with first and second character set, respectively, the messages stored in the message memory being displayed on a display window in either one of a multiple message display mode or a single message display mode; and a read only memory having a character translating unit operative in response to a selection command from said message control means to translate the set of the characters between the first and second character set without a change in meaning; wherein said message control means having a message selection control unit adapted to select either one of the multiple display mode and the single display mode to display the message on the display window with the characters of the set corresponding to the selected display mode, said message control means displaying the messages with characters of either one of the first or the second character set on the display window when the multiple message display mode is selected, and displaying only one of the messages with the characters of the other of the first or the second character set on the display window when the single message display mode is selected.

2. A radio paging receiver as claimed in claim 1, wherein the message selection control unit selects, when the radio paging receiver is operated in the multiple message display mode and a user wants to display only particular one of the displayed messages, the particular one of the messages and displays the selected message on the display window with the characters of the set corresponding to the single message display mode.

3. A radio paging receiver as claimed in claim 1, wherein the message selection control unit displays one message in each line, and wherein a predetermined length for portion from the head of each message is displayed in each line on the display window.

4. A radio paging receiver as claimed in claim 1, wherein the first and the second character set have first and second character sizes, respectively, and the messages in the first and the second character tables are displayed on the display window with the characters of the first and the second sizes, respectively.

5. A radio paging receiver as claimed in claim 4, wherein the first character size is larger than the second character size.

6. A radio paging receiver as claimed in claim 1, wherein the first character set is composed of a set of hiragana face characters in combination with kanji face characters of the first character size, and the second character set is composed of a set of katakana face characters of the second character size.

7. A radio paging receiver as claimed in claim 1, wherein the first character set is composed of a set of hiragana face characters in combination with katakana and kanji face characters of the first character size, and the second character set is composed of a set of katakana face characters of the second character size.

8. A radio paging receiver as claimed in claim 1, wherein the first character set is composed of a set of hiragana face characters in combination with katakana, kanji, and alphanumeric face characters of the first character size, and the second character set is composed of a set of katakana face characters of the second character size.

9. A radio paging receiver as claimed in claim 1, wherein the first character set is composed of a set of alphanumeric characters of the first character size, and the second character set is composed of a set of alphanumeric characters of the second character size.

10. A radio paging receiver as claimed in claim 1, wherein the first character set is composed of a set of hiragana face characters or katakana face characters in combination with at least one of kanji and katakana face characters and alphanumeric characters of the first character size, and the second character set is composed of a set of hiragana face characters or katakana face characters in combination with at least one of kanji katakana face characters and alphanumeric characters of the second character size.

11. A radio paging receiver as claimed in claim 1, wherein the first character set is composed of a set of characters of a predetermined language in combination with numerical characters of the first character size, and the second character set is composed of a set of characters of a predetermined language in combination with numerical characters of the second character size.

12. A radio paging receiver as claimed in claim 10, wherein the first character size is larger than the second character size.

13. A radio paging receiver as claimed in claim 2, wherein the selection of the particular one of the messages is made by means of high-lighting the message in question among the plurality of messages.

14. A radio paging receiver as claimed in claim 1, wherein the message selection control unit replaces, when the message of the second character set is translated into the message of the first character set and when there is no first character set corresponding to the second character set, the second character set with a particular character set and displays the message with the replaced character set on the display window.

15. A radio paging receiver as claimed in claim 2, further comprising a switch unit for use in reading the messages out and for selecting/determining the message display modes.

16. A radio paging receiver as claimed in claim 15, wherein said switch unit is a set of push switches, the set of push switches having four cursor movement switches for moving a cursor up and down as well as right and left and having a message selection and determination switch for selecting and determining a message.

17. A radio paging receiver as claimed in claim 15, wherein said switch unit is a rotary switch having a rotary section and a push switch section, the rotary section being for moving a cursor to select the message and each push switch being depressed to determine the selected message.

18. A radio paging receiver as claimed in claim 15, wherein said message control means stores, in response to reception of a call with a message, the reception message in the message memory, said message control means indicating the message selection control unit to display only the reception message with the characters of the first character set, the message selection control unit displaying the reception message with the characters of the first character set in a single line, and wherein said message control means reads the messages out of the message memory, when the message is indicated during no reception of a call, the message control means indicating the message selection control unit to display the messages with the characters of the second character set, wherein the character translating unit successively changes the size of the characters from the second to the first character size in response to the indication, the switch unit scrolling the messages, and wherein the message selection control unit translates, in response to selection and determination of a desired message, the selected message into the message with the character of the first character set, the message selection control unit driving a display control unit to display the selected message with the characters of the first character set in a single line on the display window.

* * * * *